US011468816B2

(12) United States Patent
Zhong et al.

(10) Patent No.: US 11,468,816 B2
(45) Date of Patent: Oct. 11, 2022

(54) DRIVER CIRCUIT AND DISPLAY DEVICE

(71) Applicants: BEIHAI HUIKE PHOTOELECTRIC TECHNOLOGY CO., LTD., Beihai (CN); CHONGQING HKC OPTOELECTRONICS TECHNOLOGY CO., LTD., Chongqing (CN)

(72) Inventors: Hang Zhong, Chongqing (CN); Zhi Xiong, Chongqing (CN)

(73) Assignees: BEIHAI HUIKE PHOTOELECTRIC TECHNOLOGY CO., LTD., Beihai (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/288,531

(22) PCT Filed: Mar. 6, 2020

(86) PCT No.: PCT/CN2020/078176
§ 371 (c)(1),
(2) Date: Apr. 24, 2021

(87) PCT Pub. No.: WO2020/207163
PCT Pub. Date: Oct. 15, 2020

(65) Prior Publication Data

US 2022/0013057 A1 Jan. 13, 2022

(30) Foreign Application Priority Data

Apr. 8, 2019 (CN) ..... 201910275065.X

(51) Int. Cl.
*G09G 3/20* (2006.01)
*G09G 3/36* (2006.01)

(52) U.S. Cl.
CPC ..... *G09G 3/2007* (2013.01); *G09G 3/36* (2013.01); *G09G 2300/0852* (2013.01);
(Continued)

(58) Field of Classification Search
CPC ... G09G 2300/0852; G09G 2310/0291; G09G 2310/08; G09G 2320/0673; G09G 3/2007;
(Continued)

(56) References Cited

U.S. PATENT DOCUMENTS

2016/0247482 A1* 8/2016 Zeng ..... G09G 3/3685
2018/0301099 A1* 10/2018 He ..... G09G 3/3607
2021/0280116 A1* 9/2021 Peng ..... G09G 3/20

FOREIGN PATENT DOCUMENTS

CN 104021771 A 9/2014
CN 106297690 A 1/2017
(Continued)

OTHER PUBLICATIONS

Chang Liu, the ISA written comments, Jun. 2020, CN.
Chang Liu, the International Search Report, Jun. 2020, CN.

*Primary Examiner* — Kenneth Bukowski

(57) ABSTRACT

The present application discloses a driver circuit and a display device, where the driver circuit includes a gamma circuit, the gamma circuit includes a gamma voltage generation chip and a gamma voltage output chip, the gamma voltage output chip includes a plurality of gamma voltage output circuits, and voltage maintenance circuits that are in one-to-one correspondence with the plurality of gamma voltage output circuits; and the gamma voltage generation chip generates different gamma voltages, which are output through corresponding gamma voltage output circuits.

7 Claims, 4 Drawing Sheets

(52) U.S. Cl.
CPC . *G09G 2310/0291* (2013.01); *G09G 2310/08* (2013.01); *G09G 2320/0673* (2013.01)

(58) Field of Classification Search
CPC .. G09G 3/36; G09G 2310/027; G09G 3/3685; G09G 3/3696
See application file for complete search history.

(56) References Cited

FOREIGN PATENT DOCUMENTS

| | | | | | |
|---|---|---|---|---|---|
| CN | 107945753 | A | | 4/2018 | |
| CN | 108597472 | A | | 9/2018 | |
| CN | 109509420 | A | * | 3/2019 | ..... G09G 3/20 |
| CN | 109509420 | A | | 3/2019 | |
| CN | 110111752 | A | | 8/2019 | |
| KR | 100540566 | B1 | | 1/2006 | |

* cited by examiner

DRIVER CIRCUIT AND DISPLAY DEVICE

CROSS REFERENCE OF RELATED APPLICATIONS

The present application claims priority to the Chinese Patent Application No. CN201910275065.X, filed with the China National Intellectual Property Administration on Apr. 8, 2019 and entitled "DRIVER CIRCUIT AND DISPLAY DEVICE", which is incorporated herein by reference in its entirety.

TECHNICAL FIELD

The present application relates to the field of display technologies, and in particular, to a driver circuit and a display device.

BACKGROUND

The statements herein only provide background information related to the present application, and do not necessarily constitute related art.

A display panel of a liquid crystal display needs to obtain a gamma reference voltage from the outside through a driver circuit to display an image, and each gamma reference voltage corresponds to one gray scale. Gray scale voltages of different sizes are respectively used to drive liquid crystals in sub-pixels of the liquid crystal panel to rotate, so that light transmittance (that is, brightness) of each sub-pixel is determined by a rotation angle of a liquid crystal molecule to achieve the purposes of gray scale display and image development. A gamma reference voltage is generated through a resistor arranged on a printed circuit board (PCB), or a plurality of groups of gamma reference voltages are generated through a programmable gamma generation chip. The plurality of groups of gamma reference voltages are routed by a source-side chip on film through a fan-out area of the display, and then are connected to a display area of the display.

Output of each gamma voltage gamma corresponds to one gamma data circuit and one digital-to-analog converter. Taking 14 gamma output voltages as an example, 14 digital-to-analog converters are needed, which is highly costly.

SUMMARY

The objective of the present application is to provide a cost-saving driver circuit and display device.

The present application discloses a driver circuit, where the driver circuit includes a gamma circuit, the gamma circuit includes a gamma voltage generation chip and a gamma voltage output chip, the gamma voltage generation chip is coupled to the gamma voltage output chip, the gamma voltage output chip includes a plurality of gamma voltage output circuits, and voltage maintenance circuits that are in one-to-one correspondence with the plurality of gamma voltage output circuits; and the gamma voltage generation chip generates different gamma voltages and outputs them to the voltage maintenance circuits of the gamma voltage output chip, and the voltage maintenance circuits maintain values of the received gamma voltages and turn on corresponding gamma voltage output circuits based on different gamma voltages for outputting.

The present application further discloses a driver circuit, where the driver circuit includes a gamma circuit, the gamma circuit includes a gamma data circuit, a digital-to-analog conversion circuit, a gamma voltage output circuit, a switch control circuit, a switch, a storage capacitor, a buffer, and a timing controller; the gamma data circuit provides gamma data; the digital-to-analog conversion circuit is coupled to the gamma data circuit to convert the gamma data provided by the gamma data circuit into a gamma voltage; the gamma voltage output circuit receives the gamma voltage output by the digital-to-analog conversion circuit and outputs the gamma voltage; there are a plurality of switches, which control output of different gamma voltages; there are a plurality of buffers, which output different gamma voltages; there are a plurality of storage capacitors, each of which is connected between each of the switches and a buffer corresponding to the switch; and the timing controller turns on corresponding switches based on different gamma voltages to output the gamma voltages.

The present application further discloses a display device, including a display panel and a driver circuit, where the driver circuit drives the display panel, and the driver circuit includes any gamma circuit described above.

With respect to the solution in which generation of each group of gamma voltages requires one group of corresponding gamma data circuit and digital-to-analog conversion circuit, in the present application, a voltage maintenance circuit corresponding to a gamma voltage unit is arranged to ensure stable output of a gamma voltage, so that a plurality of gamma voltage units can share a gamma data circuit and a digital-to-analog conversion circuit. In this way, a quantity of gamma data circuits and/or digital-to-analog conversion circuits used in the gamma voltage output chip can be reduced, helping reduce production costs.

BRIEF DESCRIPTION OF DRAWINGS

The included drawings are intended to provide a further understanding of one or more embodiments of the present application, which constitute a part of the specification. The drawings are used to illustrate the implementations of the present application, and together with the text description, explain the principle of the present application. Clearly, the drawings in the following description are merely some embodiments of the present application. A person of ordinary skill in the art can derive other drawings from these drawings without creative efforts. In the drawings.

DETAILED DESCRIPTION OF EMBODIMENTS

Figure 1:
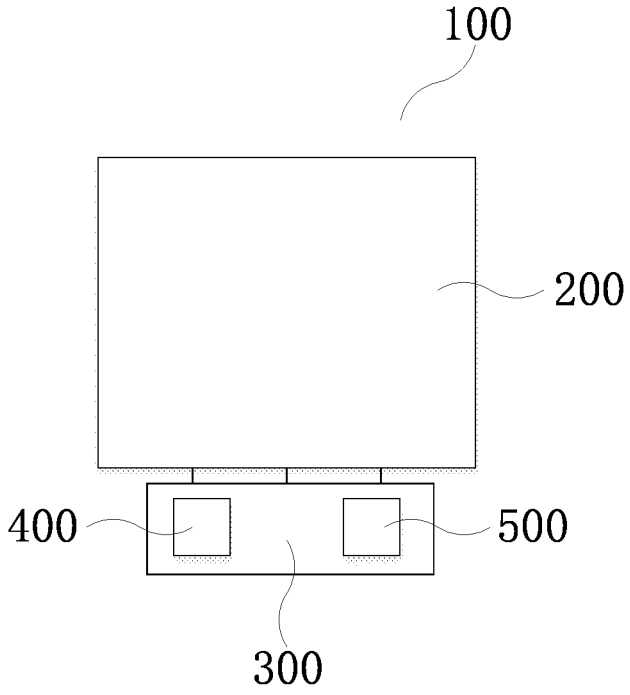
FIG. 1 is a schematic diagram of a display device according to one or more embodiments of the present application.

It should be understood that the used terms, and the disclosed specific structures and functional details herein are merely for describing one or more specific embodiments and are representative. However, the present application can be specifically implemented in many alternative forms, and should not be interpreted to be limited to one or more embodiments described herein.

The terms "first" and "second" in the description of the present application are merely intended for a purpose of description, and shall not be understood as an indication of relative importance or an implicit indication of a quantity of indicated technical features. Hence, unless otherwise stated, the features defined by "first" and "second" can explicitly or implicitly include one or more features; and "a plurality of" means two or more. The term "include" and any variations thereof are intended to cover a non-exclusive inclusion, and there may be the presence or addition of one or more other features, integers, steps, operations, elements, components and/or combinations thereof.

In addition, the orientation or position relationships indicated by the terms "center", "transversal", "upper", "lower", "left", "right", "vertical", "horizontal", "top", "bottom", "inner", "outer", etc. are based on the orientation or position relationships shown in the drawings, for ease of the description of the present application and simplifying the description only, rather than indicating that the indicated device or element must have a particular orientation or be constructed and operated in a particular orientation. Therefore, these terms should not be understood as a limitation on the present application.

In addition, unless otherwise specified and defined, the terms "install", "connected with", and "connected to" should be comprehended in a broad sense. For example, these terms may be comprehended as being fixedly connected, detachably connected or integrally connected; mechanically or electrically connected; or directly connected or indirectly connected through an intermediate medium, or in internal communication between two elements. The specific meanings about the foregoing terms in the present application may be understood by a person of ordinary skill in the art depending on specific circumstances.

The following further describes the present application with reference to drawings and one or more optional embodiments.

As shown in FIG. 1, an embodiment of the present application discloses a display device 100, including a display panel 200 and a driver circuit 300, where the driver circuit 300 drives the display panel 200, and the driver circuit 300 includes a gamma circuit 400.

Figure 2:
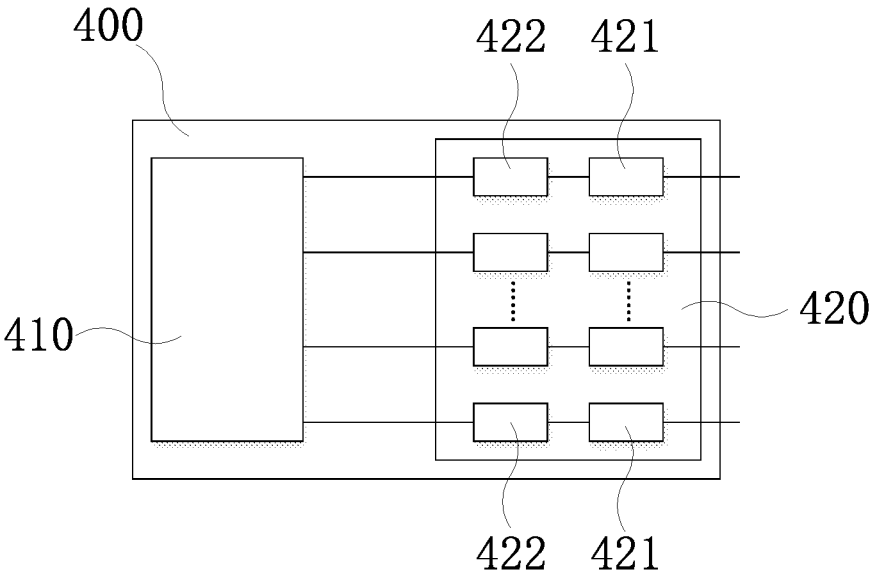
FIG. 2 is a schematic diagram of a gamma circuit according to one or more embodiments of the present application.

As shown in FIG. 2, the gamma circuit 400 includes a gamma voltage generation chip 410 and a gamma voltage output chip 420, the gamma voltage output chip 420 includes a plurality of gamma voltage output circuits 421, and voltage maintenance circuits 422 that are in one-to-one correspondence with the plurality of gamma voltage output circuits 421. The gamma voltage generation chip 410 generates different gamma voltages and outputs them to the voltage maintenance circuits 422 of the gamma voltage output chip 420, and the voltage maintenance circuits 422 maintain values of the received gamma voltages and turn on corresponding gamma voltage output circuits 421 based on different gamma voltages for outputting.

Figure 3:
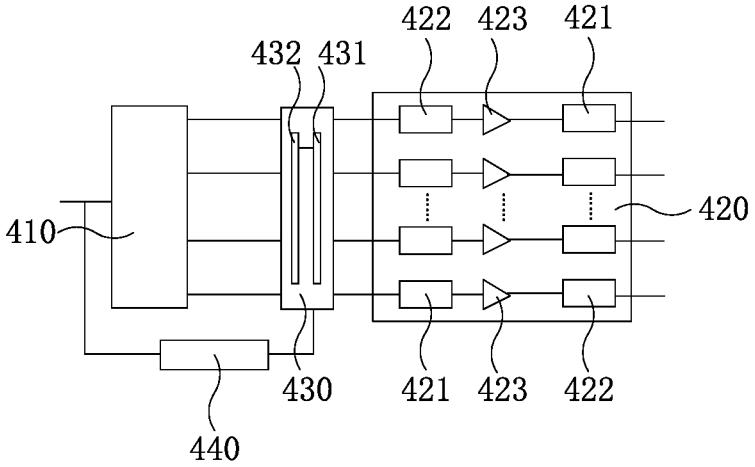
FIG. 3 is a schematic diagram of another gamma circuit according to one or more embodiments of the present application.
Figure 4:
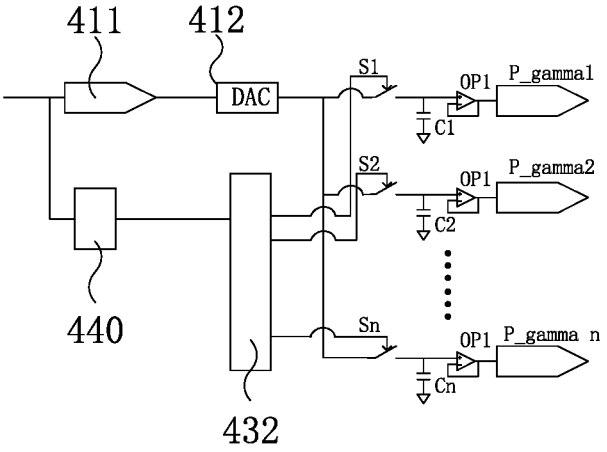
FIG. 4 is a schematic diagram of a gamma circuit with only one DAC according to one or more embodiments of the present application.

As shown in FIG. 3 and FIG. 4, the gamma circuit 400 is provided with a timing switch control circuit 430. The timing switch control circuit 430 includes a plurality of switches 431 that are in one-to-one correspondence with a plurality of gamma voltage units, and a switch control circuit 432 that controls different switches to be turned on in different time periods. In addition, the timing switch control circuit 430 further incorporates a timing controller 440 that is separately coupled to the gamma data circuit 411 and the timing switch control circuit 430. The timing controller 440 can be integrated into the gamma data circuit 411 and/or the control circuit, or may be arranged in another circuit and coupled to the switch control circuit 432.

The gamma data circuit 411 switches and outputs different gamma data under control of the timing controller 440. At the same time, the timing switch control circuit 430 synchronously turns on switches corresponding to the gamma data based on the timing controller 440, to turn on gamma voltage output circuits 421 corresponding to the gamma data to output corresponding gamma voltages. The timing switch control circuit 430 generates different gamma voltages based on the gamma voltage generation chip 410, and turns on switches corresponding to different gamma voltages, so as to turn on corresponding gamma voltage output circuits 421 to output corresponding gamma voltages. In this way, the turn-off and turn-on of each gamma circuit 400 can be controlled by timing, which is more intelligent.

To achieve stable output of the gamma voltage while reducing costs, the gamma voltage generation chip 410 includes one gamma data circuit 411 and one digital-to-analog conversion circuit 412. An output end of the gamma data circuit 411 is connected to an input end of the digital-to-analog conversion circuit 412. The gamma data circuit 411 outputs different gamma data to the digital-to-analog conversion circuit 412, and the digital-to-analog conversion circuit 412 generates different gamma voltages based on the received different gamma data, and turns on corresponding switches to turn on corresponding gamma voltage output circuits 421 for outputting. A plurality of the switches are respectively arranged between the digital-to-analog conversion circuit 412 and the gamma voltage output circuit 421. Based on different gamma data of the gamma data circuit 411, switches corresponding to the gamma data are turned on to turn on gamma voltage output circuits 421 corresponding to the gamma data. The digital-to-analog conversion circuit 412 includes a digital-to-analog converter (DAC).

Each of the voltage maintenance circuits 422 includes one storage capacitor C, or may certainly include a circuit or another element having the identical function. To reduce power consumption for gamma voltage output, each of the gamma voltage output circuits 421 includes one buffer 423. Each of the storage capacitors is connected between each of the switches and a buffer 423 (hereinafter represented by OP) corresponding to the switch. Each of the storage capacitors is charged when the corresponding switch is turned on. A capacitance value of the storage capacitor is adjustable, and a capacitance value of the capacitor on each gamma circuit 400 can be adjusted based on an actual circuit. When the corresponding switch is turned off, the gamma voltage output of the gamma voltage output circuit 421 is maintained. The gamma data circuit 411 switches and outputs different gamma data under waveform control of the timing controller 440. At the same time, the timing switch control circuit 430 is controlled to turn on switches corresponding to the gamma data, so as to turn on gamma voltage output circuits 421 corresponding to the gamma data. Based on adjustment of the capacitance value of the capacitor and the switching frequency of the switch, the best state with stable output and reduced load can be further found.

Figure 5:
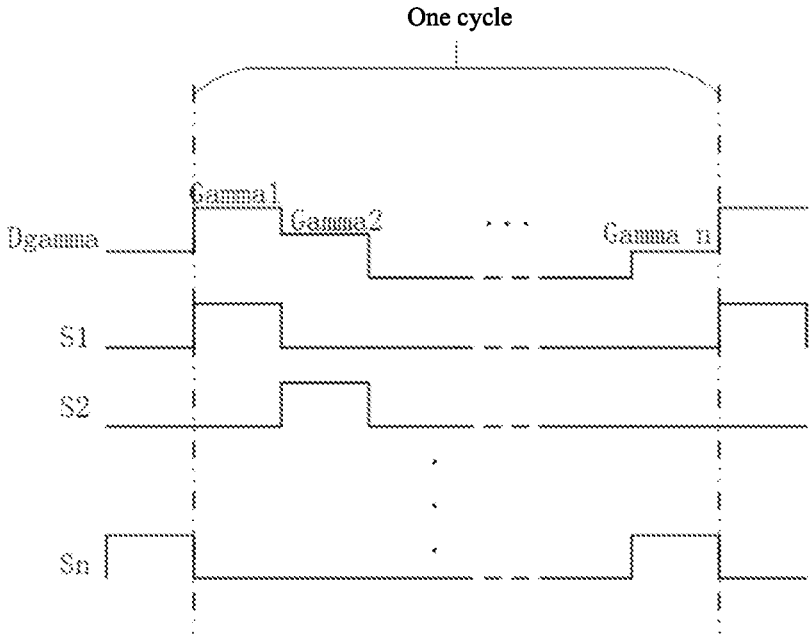
FIG. 5 is a schematic diagram of data gamma output according to one or more embodiments of the present application.

As shown in FIG. 4 and FIG. 5, a switch control circuit controls S1 to connect a DAC and a first gamma voltage output circuit. In this case, input gamma data of a public DAC is a data signal of a first output voltage gamma1, and the DAC applies a converted analog voltage signal to both ends of the capacitor C1 and provides the converted analog voltage signal to OP1. Finally, P-gamma1 is output. After S1 is connected for a period of time, the timing controller 440 controls the switch control circuit 432 to disconnect S1 and connect S2. At the same time, the input gamma data of the public DAC is switched to a data signal of a second output voltage P-gamma2. In this case, in the first output, C1 maintains the voltage of OP1; and in the second output, the DAC applies the converted analog voltage signal to both ends of a capacitor C2, and provides the converted analog voltage signal to OP2. Finally, P-gamma2 is output.

Similarly, after S2 is connected for a period of time, the switch control circuit 432 disconnects S2 and connects S3. At the same time, the input gamma data of the public DAC is switched to a data signal of a third output voltage P-gamma3. In this case, in the first output, C1 maintains the voltage of OP1; and in the second output, C2 maintains the voltage of OP2, the DAC in the third output applies the converted analog voltage signal to both ends of a capacitor C3, and provides the converted analog voltage signal to OP3. Finally, P-gamma3 is output.

Similarly, after S n-1 is connected for a period of time, the switch control circuit 432 disconnects S n-1 and connects S n. At the same time, the input gamma data of the public DAC is switched to a data signal of an n-th output voltage gamma n. In this case, in the first output, C1 maintains the voltage of OP1; and in the second output, C2 maintains the voltage of OP2, . . . , in the (n-1)-th output, C n-1 maintains the voltage of OP n-1, the DAC in the n-th output applies the converted analog voltage signal to both ends of a capacitor C n, and provides the converted analog voltage signal to OP n. Finally, gamma n is output.

Finally, after S n is connected for a period of time, the switch control circuit 432 disconnects S n and connects S1. At the same time, the input gamma data D-gamma of the public DAC is switched to a data signal of a first output voltage gamma 1. In this case, in the second output, C2 maintains the voltage of OP2, . . . , in the n-th output, C n maintains the voltage of OP n, the DAC in the first output applies the converted analog voltage signal to both ends of a capacitor C1, and provides the converted analog voltage signal to OP1. Finally, gametal is output. Up until now, one cycle has been completed, and subsequent processing will be performed in the same way.

In one or more embodiments, which differ from the foregoing one or more embodiments in that the gamma voltage generation chip 410 includes a plurality of digital-to-analog conversion circuits 412, the plurality of digital-to-analog conversion circuits 412 are connected to the plurality of gamma voltage output circuits 421 in one-to-one correspondence through the plurality of voltage maintenance circuits 422; the gamma voltage generation chip 410 further includes one gamma data circuit 411; and different DACs have different reference voltages to achieve more accurate gamma voltage output.

One gamma data circuit 411 can alternatively output a plurality of pieces of different gamma data to different digital-to-analog conversion circuits 412, and the different digital-to-analog conversion circuits 412 turn on corresponding gamma voltage output circuits 421 based on the received different gamma data to output corresponding gamma voltages.

Certainly, the gamma voltage generation chip 410 may alternatively include a plurality of gamma data circuits 411, but a quantity of gamma data circuits 411 is less than a quantity of the digital-to-analog conversion circuits 412. Different gamma data circuits 411 output different gamma data to different DACs, the identical gamma data circuit 411 can also output different gamma data to different DACs, and the different DACs turn on corresponding gamma voltage output circuits 421 based on the received different gamma data to output corresponding gamma voltages. In this way, costs can be reduced.

Figure 6:
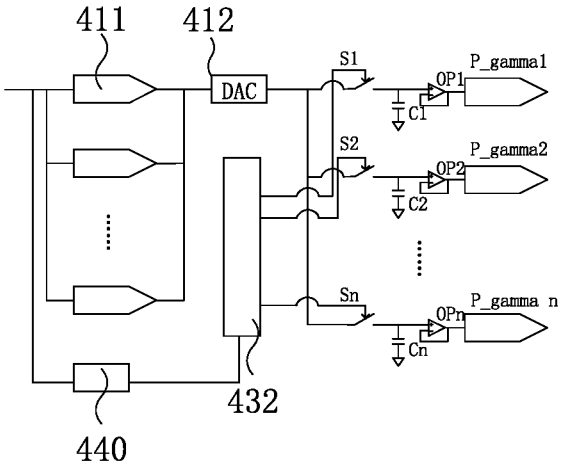
FIG. 6 is a schematic diagram of a gamma circuit with a plurality of data gamma units according to one or more embodiments of the present application.
Figure 7:
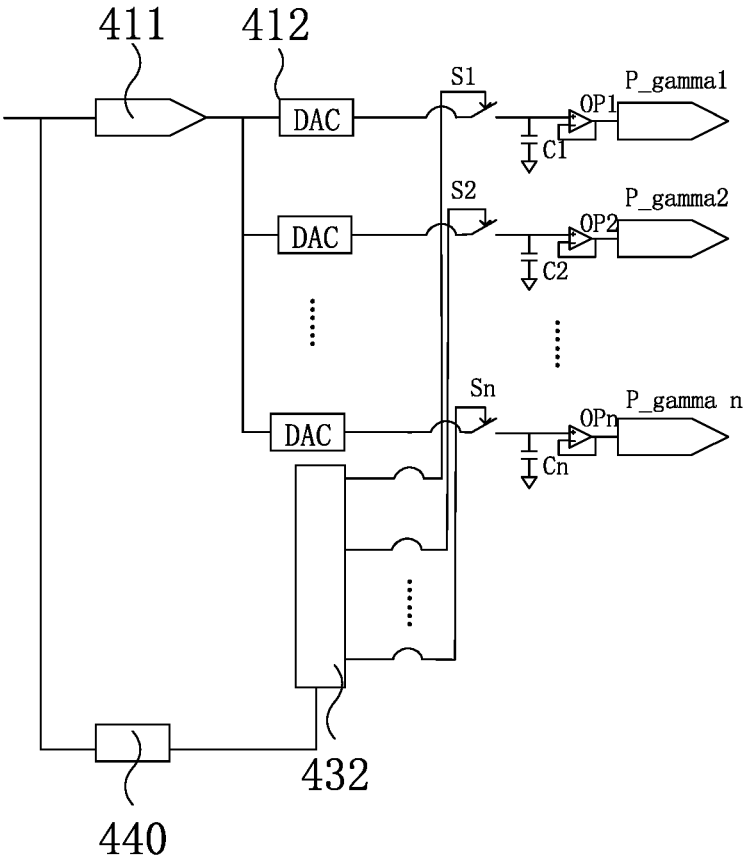
FIG. 7 is a schematic diagram of a gamma circuit with one gamma data circuit and a plurality of digital-to-analog conversion circuits according to one or more embodiments of the present application.

In one or more embodiments, as shown in FIG. 6, the gamma voltage generation chip 410 includes a plurality of gamma data circuits 411 and one digital-to-analog conversion circuit 412, and a quantity of the gamma data circuits 411 may be equal to or less than a quantity of the gamma voltage output circuits 421. The plurality of gamma data circuits 411 generate a plurality of pieces of different gamma data and output them to the digital-to-analog conversion circuit 412, and the identical digital-to-analog conversion circuit 412 turns on corresponding gamma voltage output circuits 421 based on the received different gamma data to output corresponding gamma voltages.

Certainly, the gamma voltage generation chip 410 includes a plurality of gamma data circuits 411 and a plurality of DACs. A quantity of the gamma data circuits 411 is equal to a quantity of the gamma voltage output circuits 421, and a quantity of the DACs is less than the quantity of the gamma data circuits 411. The plurality of gamma data circuits 411 generate a plurality of pieces of different gamma data, and one DAC can receive one or more pieces of gamma data and convert them. The different DACs turn on corresponding gamma voltage output circuits 421 based on the received different gamma data to output corresponding gamma voltages, and the identical DAC turns on corresponding gamma voltage output circuits 421 based on the received different gamma data to output corresponding gamma voltages. In this way, costs of the DAC can be reduced.

In one or more embodiments of the present application, referring to FIG. 1 and FIG. 3, a driver circuit 300 is disclosed, where the driver circuit 300 includes a gamma circuit 400 and another gamma circuit 500. The gamma circuit 400 includes a gamma data circuit 411, a digital-to-analog conversion circuit 412, a switch, a capacitor, a buffer 423, and a timing controller 440. The gamma data circuit 411 provides gamma data. The digital-to-analog conversion circuit 412 is coupled to the gamma data circuit 411, and converts the gamma data provided by the gamma data circuit 411 into a gamma voltage. There are a plurality of switches, which control output of different gamma voltages. There are a plurality of buffers 423, which output different gamma voltages. There are a plurality of storage capacitors, each of which is connected between each switch and a buffer 423 corresponding to the switch. The timing controller 440 turns on corresponding switches based on different gamma voltages to output the gamma voltages.

The driver circuit 300 further includes the another gamma circuit 500. The another gamma circuit 500 and the gamma circuit 400 jointly output all the gamma output voltages. A circuit architecture of the another gamma circuit 500 is different from that of the gamma circuit 400. The another gamma circuit 500 includes all architectures of the gamma circuit 400 and further includes an existing commonly used architecture. However, when one of the circuit architectures is selected for the gamma circuit 400, another circuit architecture of the gamma circuit 400 or a prior-art architecture may be selected for the another gamma circuit 500.

The technical solutions of the present application can be widely used in various display panels, such as a twisted nematic (TN) display panel, an in-plane switching (IPS) display panel, a vertical alignment (VA) display panel, and a multi-domain vertical alignment (MVA) display panel, or may certainly be used in other types of display panels, such as an organic light-emitting diode (OLED) display panel. The foregoing solutions are applicable to all these display panels.

The foregoing content further describes the present application in detail with reference to one or more specific optional embodiments, and the specification should not be construed as a limitation on the one or more specific embodiments of the present application. A person of ordinary skill in the art to which the present application relates may make some simple derivations or replacements without departing from the idea of the present application, and the derivations or replacements should all fall within the protection scope of the present application.

What is claimed is:

1. A driver circuit, wherein the driver circuit comprises a gamma circuit, and the gamma circuit comprises:

a gamma voltage generation chip; and a gamma voltage output chip, which comprises a plurality of gamma voltage output circuits, and voltage maintenance circuits that are in one-to-one correspondence with the plurality of gamma voltage output circuits, wherein the gamma voltage generation chip generates different gamma voltages and outputs them to the voltage maintenance circuits of the gamma voltage output chip, and the voltage maintenance circuits maintain values of the received gamma voltages and turn on corresponding gamma voltage output circuits based on different gamma voltages for outputting;

wherein the gamma voltage generation chip comprises a plurality of digital-to-analog conversion circuits, the plurality of digital-to-analog conversion circuits are connected to the plurality of gamma voltage output circuits in one-to-one correspondence through the plurality of voltage maintenance circuits; and the gamma voltage generation chip further comprises one gamma data circuit, wherein the gamma data circuit outputs different gamma data to corresponding digital-to-analog conversion circuits in different time periods, and the digital-to-analog conversion circuits turn on corresponding gamma voltage output circuits based on the received different gamma data to output corresponding gamma voltages.

2. The driver circuit according to claim 1, wherein each digital-to-analog conversion circuit comprises a digital-to-analog converter.

3. The driver circuit according to claim 1, wherein each gamma voltage output circuit comprises a buffer.

4. The driver circuit according to claim 1, wherein the driver circuit further comprises another gamma circuit, and the another gamma circuit and the gamma circuit jointly output all gamma output voltages; and a circuit architecture of the another gamma circuit is different from that of the gamma circuit.

5. The driver circuit according to claim 4, wherein the another gamma circuit comprises:

a gamma voltage generation chip; and a gamma voltage output chip, which comprises a plurality of gamma voltage output circuits, wherein the gamma voltage generation chip generates different gamma voltages and outputs them to the gamma voltage output circuits of the gamma voltage output chip for outputting.

6. A display device, comprising a display panel and a driver circuit, wherein the driver circuit drives the display panel, the driver circuit comprises a gamma circuit, and the gamma circuit comprises:

a gamma voltage generation chip; and a gamma voltage output chip, which comprises a plurality of gamma voltage output circuits, and voltage maintenance circuits that are in one-to-one correspondence with the plurality of gamma voltage output circuits, wherein the gamma voltage generation chip generates different gamma voltages and outputs them to the voltage maintenance circuits of the gamma voltage output chip, and the voltage maintenance circuits maintain values of the received gamma voltages and turn on corresponding gamma voltage output circuits based on different gamma voltages for outputting;

wherein the gamma voltage generation chip comprises a plurality of digital-to-analog conversion circuits, the plurality of digital-to-analog conversion circuits are connected to the plurality of gamma voltage output circuits in one-to-one correspondence through the plurality of voltage maintenance circuits; and the gamma voltage generation chip further comprises one gamma data circuit, wherein the gamma data circuit outputs different gamma data to corresponding digital-to-analog conversion circuits in different time periods, and the digital-to-analog conversion circuits turn on corresponding gamma voltage output circuits based on the received different gamma data to output corresponding gamma voltages.

7. The display device according to claim 6, wherein the driver circuit further comprises another gamma circuit, and the another gamma circuit and the gamma circuit jointly output all gamma output voltages; and a circuit architecture of the another gamma circuit is different from that of the gamma circuit.

* * * * *